United States Patent [19]

Kennedy et al.

[11] 3,953,892

[45] May 4, 1976

[54] SAFETY SWIM CAP

[76] Inventors: James R. Kennedy; Carole Joy Kennedy, both of 999 NE. 23rd Drive, Fort Lauderdale, Fla. 33305

[22] Filed: Mar. 4, 1975

[21] Appl. No.: 555,154

[52] U.S. Cl. ..... 2/3 R
[51] Int. Cl.[2] ..... A42B 1/08
[58] Field of Search ..... 2/68, 3 R

[56] References Cited

UNITED STATES PATENTS

| | | | |
|---|---|---|---|
| 1,072,321 | 9/1913 | Fitch | 2/3 R |
| 1,946,981 | 2/1934 | Lower | 220/DIG. 19 |
| 2,121,702 | 6/1938 | Larkin | 2/3 R |
| 3,028,036 | 4/1962 | Goll | 217/110 |
| 3,283,349 | 11/1966 | White | 2/68 X |
| 3,555,561 | 1/1971 | Neis | 2/3 R |

*Primary Examiner*—Alfred R. Guest
*Attorney, Agent, or Firm*—Marden S. Gordon

[57] ABSTRACT

A safety swim cap provided in a variety of fluorescent colors and consisting of a multitude of interconnected deflatable tubes disposed in a network to provide an outer rim surrounding an individual's head at the forehead portion thereof and criss-crossing tubes extending over the top of the individual's head, the tubes being inflatable from a single valve, and with a chin strap and buckle arrangement extending down from opposite portions of the rim tube in a manner to be secured beneath an individual's chin to retain the cap in position on the individual's head. These fluorescent colors will provide sharp visibility in placid or rough waters.

1 Claim, 6 Drawing Figures

SAFETY SWIM CAP

BACKGROUND OF THE INVENTION

1. Field of the Invention

This invention relates generally to wearing apparel and more particularly to a novel and improved safety swim cap for swimmers for both the protection of the swimmer's head as well as to provide identification of different swimmers while in the water.

2. Description of the Prior Art

It has been known in the prior art to provide swim caps of a watertight nature to keep an individual's hair dry while swimming, these caps providing little if any protection for the individual's head during swimming so that they are unsatisfactory for use as protective gear during water sports.

It has also been known in the prior art to provide head gear, such as crash helmets and the like, to protect an individual's head during participation in sports. However, these are unsatisfactory for participation in those water sports where the individual is swimming because they are too heavy, too buoyant, uncomfortable to the wearer, and may provide injury to other players of the sport while swimming in the water.

Prior art protective headgear thus suffer from many problems and difficulties when attempting to utilize the same for protecting an individual's head in water sports.

SUMMARY OF THE INVENTION

The present invention recognizes the deficiencies and disadvantages of presently available protective headgear as to its not being fully suitable for use in protecting a swimmer's head in participating in water sports, and the invention provides a novel solution thereto in the form of a lightweight head protecting safety swim cap which may be comfortably and conveniently worn on the head of a swimmer during water sports without interfering with the swimmer.

It is a feature of the present invention to provide a safety swim cap for use of swimmers while participating in water sports.

A further feature of the present invention provides a safety swim cap which will not interfere with the freedom of action and movement of the swimmer and which is highly suitable for wear of the swimmer during participation in water sports as it may be safely and comfortably worn in the water.

A further feature of the present invention provides a safety swim cap which is relatively simple inits construction and which therefore may be readily manufactured at a relatively low cost and by simple manufacturing methods such that it may be retailed at a low price to encourage widespread acceptance and use thereof.

Yet still a further feature of the present invention provides a safety swim cap which is of a rugged and durable construction and which therefore may be guaranteed by the manufacturer to withstand many years of intended usage.

Still a further feature of the present invention provides a safety swim cap which is aesthetically pleasing and refined in appearance.

Yet still a further feature of the present invention provides a safety swim cap which is easy to use and reliable and efficient in operation.

Other features and advantages of this invention will be apparent during the course of the following description.

BRIEF DESCRIPTION OF THE DRAWINGS

In the accompanying drawings forming a part of this Specification, and in which like reference characters are employed to designate like parts throughout the same.

DESCRIPTION OF THE PREFERRED EMBODIMENT

Figure 1:
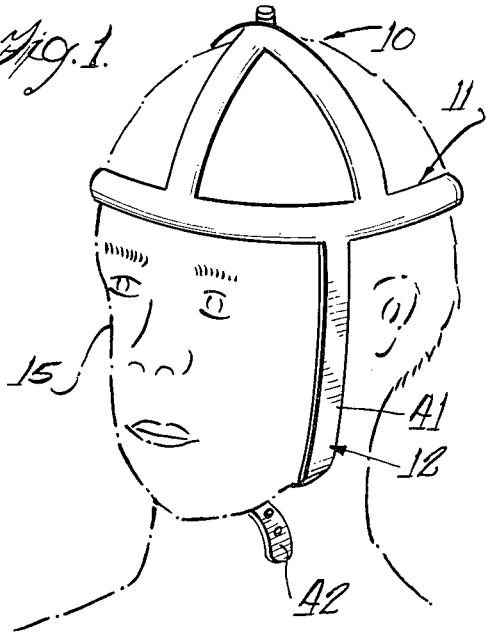
FIG. 1 is a perspective view of the safety swim cap of the invention illustrated as worn in the intended manner on the head of an individual.
Figure 2:
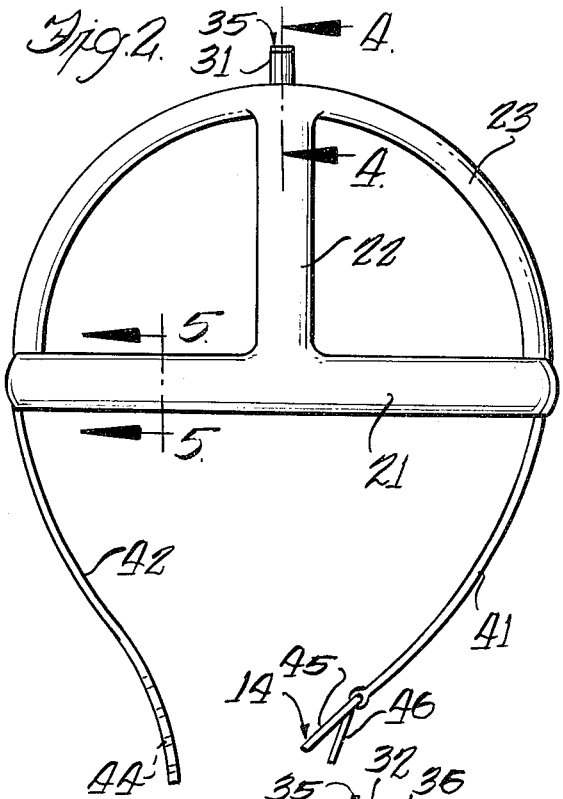
FIG. 2 is a front elevational view of the safety swim cap.
Figure 3:
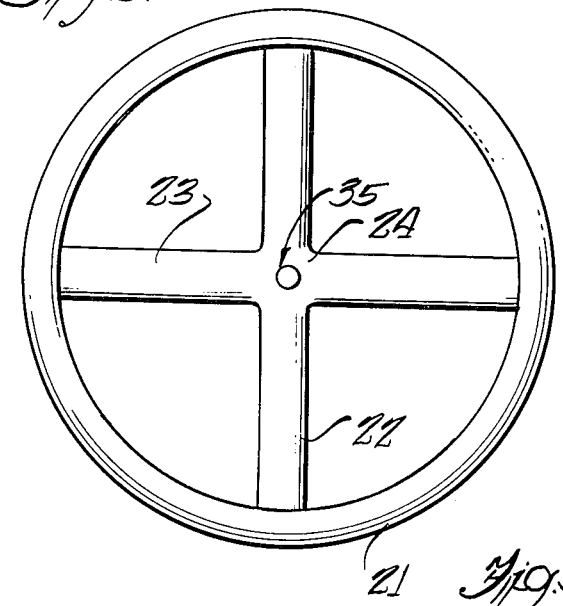
FIG. 3 is a top plan view of the safety swim cap.
Figure 4:
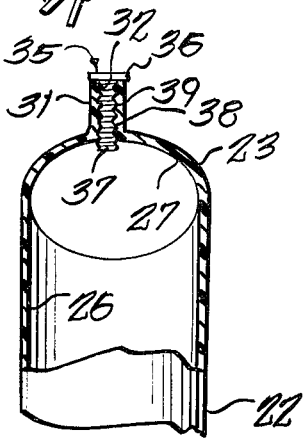
FIG. 4 is an enlarged fragmentary cross-sectional view taken along line 4—4 of FIG. 2.
Figure 5:
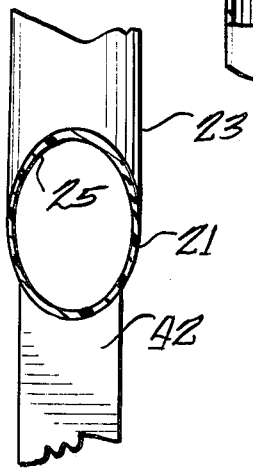
FIG. 5 is an enlarged cross-sectional view taken along line 5—5 of FIG. 2.
Figure 6:
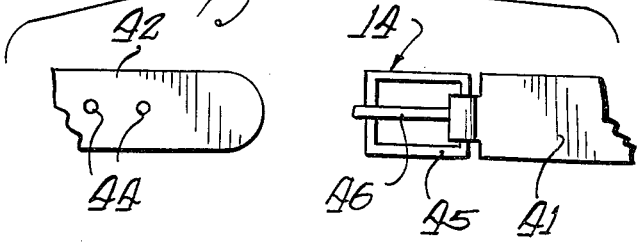
FIG. 6 is a fragmentary front elevational view of a portion of the chin strap and the buckle associated therewith.

Referring now to the drawings in detail there is illustrated a preferred form of a safety swim cap constructed in accordance with the principles of the present invention and which is designated generally in its entirety by the reference 10 and which is comprised of a network of criss-crossing inflatable tubes 11 with the rim forming tube thereof having affixed thereto a chin strap 12 adapted to be passed around the chin of an individual having the swim cap on the individual's head with one of the ends of the strap having a buckle 14 affixed thereto for use in securing the opposite end of the strap thereto.

The safety swim cap 10 is manufactured out of plastic, vinyl, rubber, or any other suitable satisfactory material providing an aesthetically pleasing and refined appearance and which may be provided in a wide variety of different fluorescent colors for purposes of identification of the swimmers wearing the cap on their heads while in the water.

The tubes 11 of the cap 10 are manufactured of a hollow vinyl tubing including a rim portion 21 defining an oblong ring shape adapted to be worn about the forehead of an individual such as individual 15, with there being formed integrally therewith or heat sealed thereto a pair of semi-circular ring portions 22 and 23 criss-crossing in center portion 24. The tube portion 22 extends longitudinally of rim portion 21 from a midpoint thereof approximately centrally of individual's 15 forehead to a position diametrically opposed therefrom at the opposite end of the rim portion, with tube portion 23 disposed at a ninety degree angle to the tube portion 22 and extending transversely to interconnect the sides of the rim portion 21. Interconnected hollow passageways 25, 26 and 27 are provided in the tubes 21, 22, and 23 respectively and are interconnected together to form a continuous air passageway therethrough.

Affixed to central portion 24 and projecting upwardly therefrom is a valve body 31 which may be formed integrally with the central portion or heat sealed thereto and which is provided with a passageway 32 interiorly thereof and which extends completely therethrough to be in communication with the air passageways 25, 26 and 27. A plug type stopper 35 is provided having a flat disc shaped head portion 36 with an elongated resiliently flexible shaft 37 formed integrally therewith an projecting downwardly from the center of the bottom surface thereof, the shaft having a multitude of ridges 38 and valleys 39 formed therealong with the ridges frictionally engaging the interior surface of the passage 32 when plug 35 is inserted thereinto so as to retain the plug 35 securely therein to close the passageway 32 and thus retain the air in the tube passageways 25, 26 and 27.

The strap 12 consists of a pair of flat elongated rectangular members 41 and 42 each having their top edge heat sealed or formed integrally with diametrically spaced apart positions on the rim portion tube 21 and projecting downwardly therefrom. The straps are formed of a resilient flexible material, such as rubber, vinyl, and the like.

The terminal end of strap 42 is provided with a plurality of longitudinally spaced apart openings 44. The buckle 14 consists of an open frame rectangular outer member 45 affixed along one edge to the terminal end of strap 41 and having a tongue member 46 with one end pivotally connected to the terminal end of the strap about the edge of the frame 45 affixed thereto and with the opposite end of the tongue extending outwardly therefrom to overlap the directly opposite edge of the frame 45.

In operation, a swimmer removes the cap or stopper 35 from valve body 31 and blows thereinto in a manner to inflate the tubes 21, 22 and 23 to the desired degree of inflation, after which the stopper is replaced in the valve body with the ridges 38 frictionally engaging the interior of the passageway 32 and thus maintaining the stopper in place in the valve body to prevent air from escaping from the tube passageways therethrough while still permitting the stopper to be manually removed from the valve for purposes of further inflation or deflation of the tubes. The swimmer then places the cap 10 on his head with the chin strap 12 extending downwardly along opposite sides of the head forwardly of the ears to be secured beneath the swimmer's chin by use of the openings 44 in strap 42 being selectively engaged with the tongue 46 of buckle 14 so that the cap is secured on the swimmer's head in a secure manner and one providing for the cap to be comfortably worn in the water while the swimmer is participating in water sports.

There is thus provided a novel safety swim cap for use by an individual for head protection while participating in water sports, with it further being understood that the swim cap of the present invention may be worn by individuals while swimming in other than water sports and used for ease of identification of the individual when the caps are provided in a multitude of colors. The criss-crossing tubes 22 and 23 extend over the individual's head with the rim portion tube 21 extending completely about the individual's head in a manner to provide a high degree of protection and safety therefore.

It is to be understood that the form of this invention herewith shown and described is to be taken as a preferred example of the same, and that this invention is not to be limited to the exact arrangement of parts shown in the accompanying drawings or described in this Specification as various changes in the details of construction as to shape, size, and arrangement of parts may be resorted to without departing from the spirit of the invention, the scope of the novel concepts thereof, or the scope of the sub-joined claims.

Having thus described the invention, what is claimed is:

1. A safety swim cap to be worn on the head of a swimmer for providing both protection and readily seen identification of the swimmer, such as when participating in water sports, the safety swim cap comprising, in combination:

a first endless oblong ring-shaped inflatable tube member having a hollow passageway extending completely therethrough, said first tube member being of a circular ring shape having a size and configuration to be positioned on an individual's head to encircle the head about the forehead and back portion of the wearer's head, said first tube member having a front portion, a back portion, and opposed side portions positioned for engaging the wearer's forehead, the wearer's back head portion, and the opposed sides of the wearer's head respectively;

a second elongated hollow resilient inflatable tube member disposed in a semi-circular configuration extending above the plane of said first tube member normal thereto and having one end connected to said front portion of said first tube member with the opposite end connected diametrically opposite the front end to said back portion of said first tube member, said second tube member having a hollow passageway in communication with said first tube member hollow passageway;

a third elongated hollow resilient inflatable tube member disposed in a semi-circular configuration extending above the plane of said first tube member normal thereto and spaced ninety degrees from said second tube member with the opposite ends of said third tube member joined to the approximate mid-points of said first tube member at the diametrically opposed side portions thereof, said third tube member having a hollow passageway in communication with said first tube member passageway and said second tube member passageway;

said second tube member and said third tube member intersecting at their point of crossing and joined together thereat centrally above said first tube member in alignment with the axis of the ring defined by said first tube member and with their respective hollow passageways in communication at the point of joining;

a pair of chin straps each extending downwardly from said first tube member to be passed beneath the chin of the wearer of the safety swim cap;

each of said chin straps consisting of a flat elongated rectangularly shaped strip of resilient material with each strap having a top end and a bottom end, the top ends of each strap affixed to diametrically opposed side portions of said first tube member with the bottom ends of each strap extending downwardly therefrom in a direction opposed to the upward projection of said second and said third tube members;

a series of longitudinally aligned and equally spaced apart openings disposed along the bottom end portion of one of said chin straps;

a rectangular frame shaped buckle having a hinged tongue member swingably associated with a bottom end thereof and with said bottom end of said frame being pivotally secured to the bottom end portion of the opposite chin strap for selectively receiving therethrough said bottom end portion of said first mentioned chin strap with said opening therein being brought into selective registration with said buckle tongue member for temporary retainment therewith to secure the safety swim cap in a secure and comfortable manner about the head of the wearer;

an elongated cylindrically shaped hollow valve body member disposed centrally of said juncture point between said second and said third tube members with said valve body member projecting vertically upwardly therefrom in a direction normal to the plane of said first tube member;

a hollow open ended passageway extending completely through said valve body member in communication with the atmosphere at one end and in communication with said tube member passageways at the opposite end, said passageway providing for the insertion and removal of air from said tube passageways through said valve body member for the selective inflation and deflation of said tube members;

a flat circularly shaped disc member having a diameter at last equal to the exterior diameter of said valve body member, said disc member having a flat top surface and a flat bottom surface;

an elongated cylindrically shaped resilient shaft having one end thereof disposed centrally of and affixed to said disc member bottom surface with the opposite end thereof extending outwardly therefrom in a direction normal thereto, the shaft being removably insertable into said valve body member passageway;

a multitude of longitudinally spaced apart parallelly disposed annular grooves each being identical to each other and extending along the complete length of said shaft and defining therebetween a plurality of spaced apart parallelly disposed annular ridges each identical to each other with each having identically tapered side walls, said ridges being of a diameter to resiliently engage the interior wall surfaces of said valve body member passageway for resiliently retaining said shaft in position therein with said disc member disposed in engagement with the open top end of said valve passageway for closing the same when said shaft is in position therein for retaining said tube member in an inflated condition;

said tube members and said chin straps each being manufactured of a flexible vinyl material; and said tube members and said chin straps being of a fluorescent color for safety recognition and identification of a swimmer when in the water and swimming to provide increased visibility of the swimmer's position to others in the water.

* * * * *